US006568549B1

(12) United States Patent
Miller

(10) Patent No.: US 6,568,549 B1
(45) Date of Patent: May 27, 2003

(54) CORK EXTRACTING DEVICE AND BOTTLE SYSTEM

(76) Inventor: Stephen J. Miller, P.O. Box 190, Batemans Bay, NSW 2536 (AU)

( * ) Notice: Subject to any disclaimer, the term of this patent is extended or adjusted under 35 U.S.C. 154(b) by 0 days.

(21) Appl. No.: 09/939,023

(22) Filed: Aug. 24, 2001

(51) Int. Cl.[7] ..... B65D 39/00

(52) U.S. Cl. ..... 215/296; 81/3.15; 215/228; 215/297; 215/305; 215/303

(58) Field of Search ..... 215/297, 296, 215/295, 303, 305, 276, 228, 299; 220/256.1, 259.1, 259.3, 259.4, 315, 327, 255, 278; 81/3.09, 3.15

(56) References Cited

U.S. PATENT DOCUMENTS

| | | | | | |
|---|---|---|---|---|---|
| 1,131,985 | A | | 3/1915 | Bellois | |
| D219,806 | S | | 2/1971 | Coleman et al. | |
| 3,774,796 | A | * | 11/1973 | Arnold | 215/296 |
| 3,776,406 | A | * | 12/1973 | Milbourne, Sr. | 215/216 |
| 3,944,104 | A | | 3/1976 | Watson et al. | |
| 4,089,433 | A | * | 5/1978 | Jonsson | 215/218 |
| 4,276,789 | A | * | 7/1981 | Allen | 81/3.36 |
| 4,446,980 | A | | 5/1984 | Oliver et al. | |
| 4,889,251 | A | | 12/1989 | Hojnoski | |
| 5,725,114 | A | * | 3/1998 | Evans et al. | 128/887 |
| 5,975,322 | A | | 11/1999 | Reid | |
| 6,422,412 | B1 | * | 7/2002 | Sagawa | 220/277 |
| 2001/0013500 | A1 | * | 8/2001 | Gilley et al. | 215/299 |
| 2002/0035754 | A1 | * | 3/2002 | Puig | 7/155 |

FOREIGN PATENT DOCUMENTS

| | | | |
|---|---|---|---|
| WO | 92/08668 | * | 5/1992 |

* cited by examiner

*Primary Examiner*—Robin Hylton

(57) ABSTRACT

A cork extraction device includes a tubular member having a first open end, a second open end and a peripheral wall having an outer threaded surface. The tubular member is positioned over an top end of a bottle. A cover member has a top wall and a perimeter wall extending downward from the top wall. The perimeter wall has an inner threaded surface. The cover member may be positioned over and threadably coupled to the tubular member when the cover member is rotated in a first direction. A corkscrew is elongate and has a first end and a second end. A disc is attached to the first end. The corkscrew is rotated in a second direction such that the second end extends through the top wall of the cover member and into a cork. The cover member is rotated in the second direction and the cork extracted from the bottle.

1 Claim, 2 Drawing Sheets

CORK EXTRACTING DEVICE AND BOTTLE SYSTEM

BACKGROUND OF THE INVENTION

1. Field of the Invention

The present invention relates to corkscrews and more particularly pertains to a new cork extracting and bottle system for facilitating removal a cork from a bottle.

2. Description of the Prior Art

The use of corkscrews is known in the prior art. More specifically, corkscrews heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,131,985; U.S. Pat. No. 4,446,980; U.S. Pat. No. 3,944,104; U.S. Pat. No. 4,889,251; U.S. Pat. No. 5,975,322; and U.S. Des. Pat. No. 219,806.

While these devices fulfill their respective, particular objectives and requirements, the aforementioned patents do not disclose a new cork extraction device. The inventive device includes a tubular member having a first open end, a second open end and a peripheral wall extending between the first and second open ends. The peripheral wall has an outer threaded surface. The first open end has an inner annular shoulder thereon. The tubular member is positioned over an top end of a bottle such that the shoulder abuts the top end. A cover member has a top wall and a perimeter wall extending downward from a perimeter edge of the top wall. The top wall has a generally circular shape. The perimeter wall has an inner threaded surface. The perimeter wall has an inner diameter generally equal to an outer diameter of the tubular member such that the cover member may be positioned over and threadably coupled to the tubular member when the cover member is rotated in a first direction. A corkscrew is elongate and has a first end and a second end and is threaded from the first end to the second end. A disc is attached to the first end. The corkscrew is rotated in a second direction such that the second end extends through the top wall of the cover member and into the cork. The cover member is rotated in the second direction such that the cork is extracted from the bottle.

In these respects, the cork extraction device according to the present invention substantially departs from the conventional concepts and designs of the prior art, and in so doing provides an apparatus primarily developed for the purpose of removing a cork from a bottle.

SUMMARY OF THE INVENTION

In view of the foregoing disadvantages inherent in the known types of corkscrews now present in the prior art, the present invention provides a new cork extraction device construction wherein the same can be utilized for removing a cork from a bottle.

The general purpose of the present invention, which will be described subsequently in greater detail, is to provide a new cork extraction device apparatus and method which has many of the advantages of the corkscrews mentioned heretofore and many novel features that result in a new cork extraction device which is not anticipated, rendered obvious, suggested, or even implied by any of the prior art corkscrews, either alone or in any combination thereof.

To attain this, the present invention generally comprises a tubular member having a first open end, a second open end and a peripheral wall extending between the first and second open ends. The peripheral wall has an outer threaded surface. The first open end has an inner annular shoulder thereon. The tubular member is positioned over an top end of a bottle such that the shoulder abuts the top end. A cover member has a top wall and a perimeter wall extending downward from a perimeter edge of the top wall. The top wall has a generally circular shape. The perimeter wall has an inner threaded surface. The perimeter wall has an inner diameter generally equal to an outer diameter of the tubular member such that the cover member may be positioned over and threadably coupled to the tubular member when the cover member is rotated in a first direction. A corkscrew is elongate and has a first end and a second end and is threaded from the first end to the second end. A disc is attached to the first end. The corkscrew is rotated in a second direction such that the second end extends through the top wall of the cover member and into the cork. The cover member is rotated in the second direction such that the cork is extracted from the bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cork extraction device apparatus and method which has many of the advantages of the corkscrews mentioned heretofore and many novel features that result in a new cork extraction device which is not anticipated, rendered obvious, suggested, or even implied by any of the prior art corkscrews, either alone or in any combination thereof.

It is another object of the present invention to provide a new cork extraction device which may be easily and efficiently manufactured and marketed.

It is a further object of the present invention to provide a new cork extraction device which is of a durable and reliable construction.

An even further object of the present invention is to provide a new cork extraction device which is susceptible of a low cost of manufacture with regard to both materials and labor, and which accordingly is then susceptible of low prices of sale to the consuming public, thereby making such cork extraction device economically available to the buying public.

Still yet another object of the present invention is to provide a new cork extraction device which provides in the apparatuses and methods of the prior art some of the advantages thereof, while simultaneously overcoming some of the disadvantages normally associated therewith.

Still another object of the present invention is to provide a new cork extraction device for removing a cork from a bottle.

Yet another object of the present invention is to provide a new cork extraction device which includes a tubular member having a first open end, a second open end and a peripheral wall extending between the first and second open ends. The peripheral wall has an outer threaded surface. The first open end has an inner annular shoulder thereon. The tubular member is positioned over an top end of a bottle such that the shoulder abuts the top end. A cover member has a top wall and a perimeter wall extending downward from a perimeter edge of the top wall. The top wall has a generally circular shape. The perimeter wall has an inner threaded surface. The perimeter wall has an inner diameter generally equal to an outer diameter of the tubular member such that the cover member may be positioned over and threadably coupled to the tubular member when the cover member is rotated in a first direction. A corkscrew is elongate and has a first end and a second end and is threaded from the first end to the second end. A disc is attached to the first end. The corkscrew is rotated in a second direction such that the second end extends through the top wall of the cover member and into the cork. The cover member is rotated in the second direction such that the cork is extracted from the bottle.

Still yet another object of the present invention is to provide a new cork extraction device that allows rotational torque to be used to remove a cork for much easier removal of the cork.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
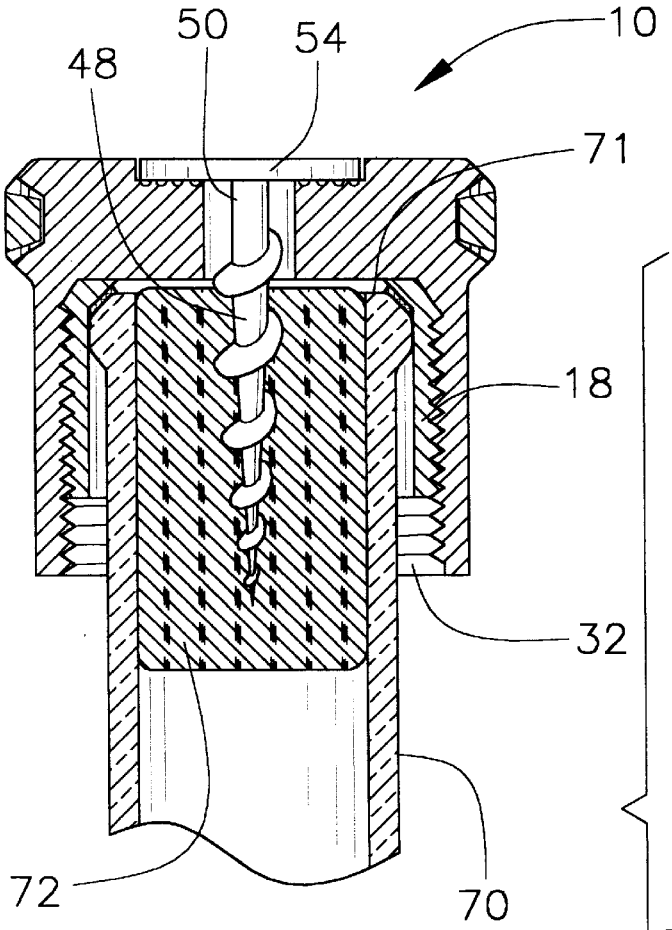
FIG. 1 is a schematic cross-sectional view of a new cork extraction device according to the present invention.
Figure 2:
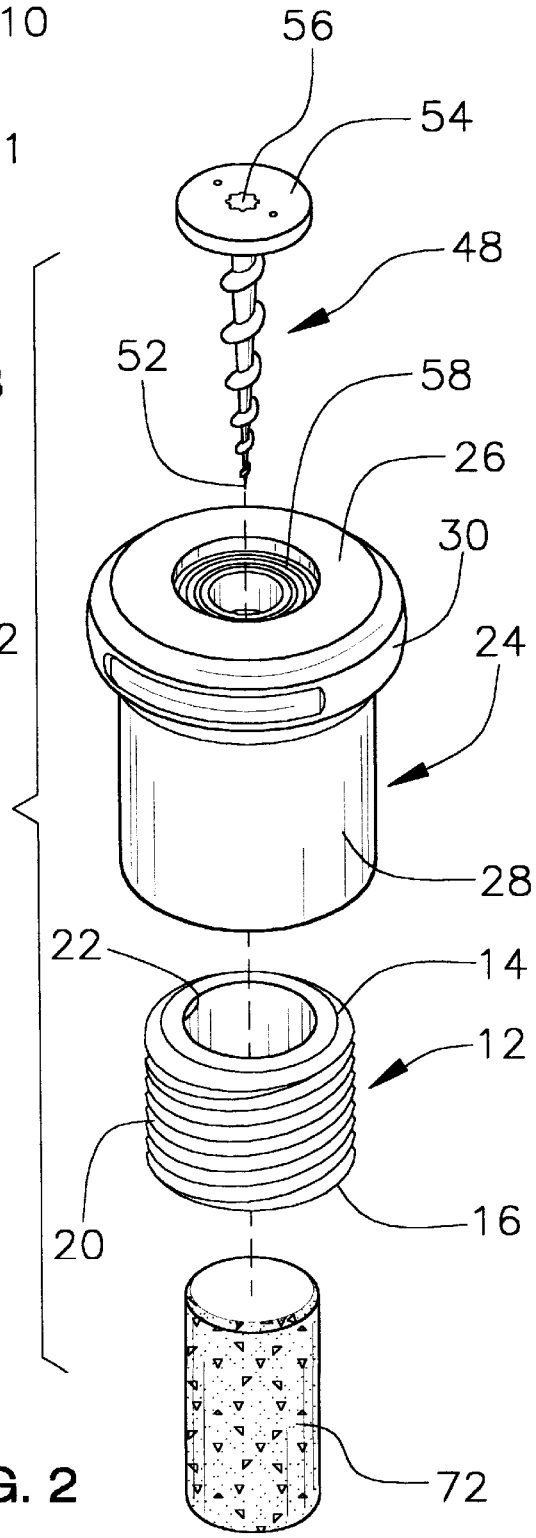
FIG. 2 is a schematic perspective view of the present invention.
Figure 3:
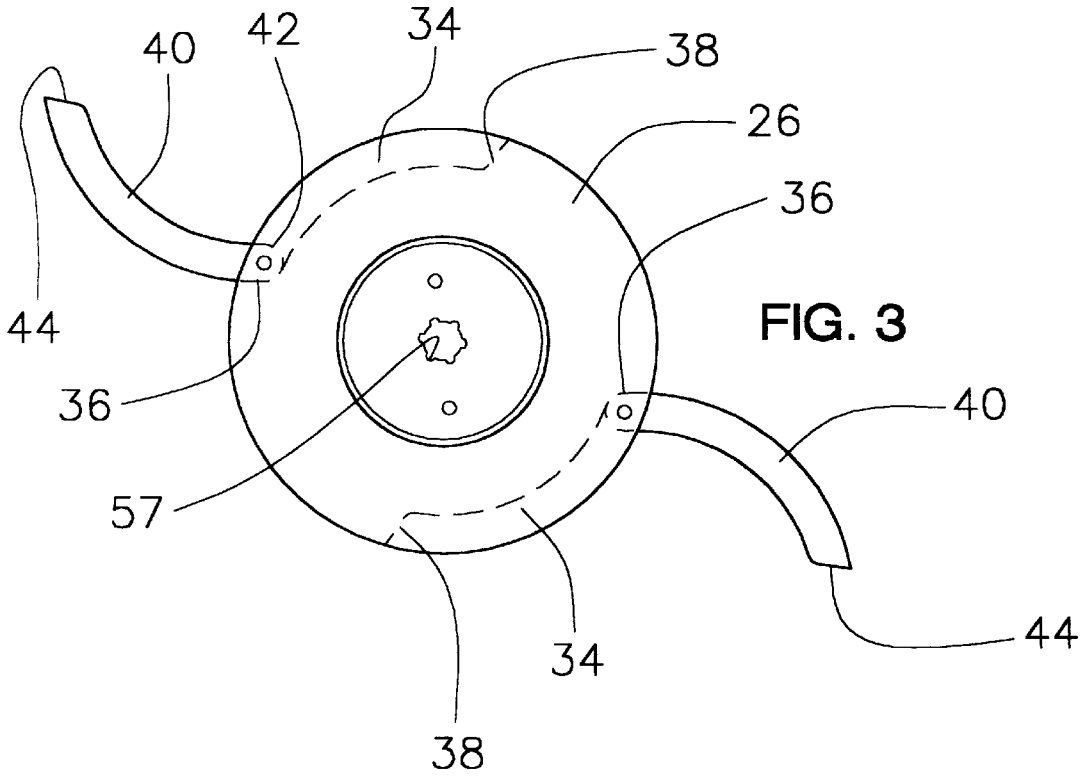
FIG. 3 is a schematic top view of the present invention.

With reference now to the drawings, and in particular to FIGS. 1 through 4 thereof, a new cork extraction device embodying the principles and concepts of the present invention and generally designated by the reference numeral 10 will be described.

As best illustrated in FIGS. 1 through 4, the cork extraction device 10 generally comprises a device for removing a cork 72 from a bottle 70. The bottle 70 has an open top end 71 having a cork 72 positioned therein. The device 10 includes a tubular member 12 having a first open end 14, a second open end 16 and a peripheral wall 18 extending between the first 14 and second 16 open ends. The peripheral wall 18 has an outer threaded surface 20. The first open end 14 has an inner annular shoulder 22 thereon. The tubular member 12 is positioned over the top end 71 of the bottle 70 such that the shoulder 22 abuts the top end 71.

Figure 4:
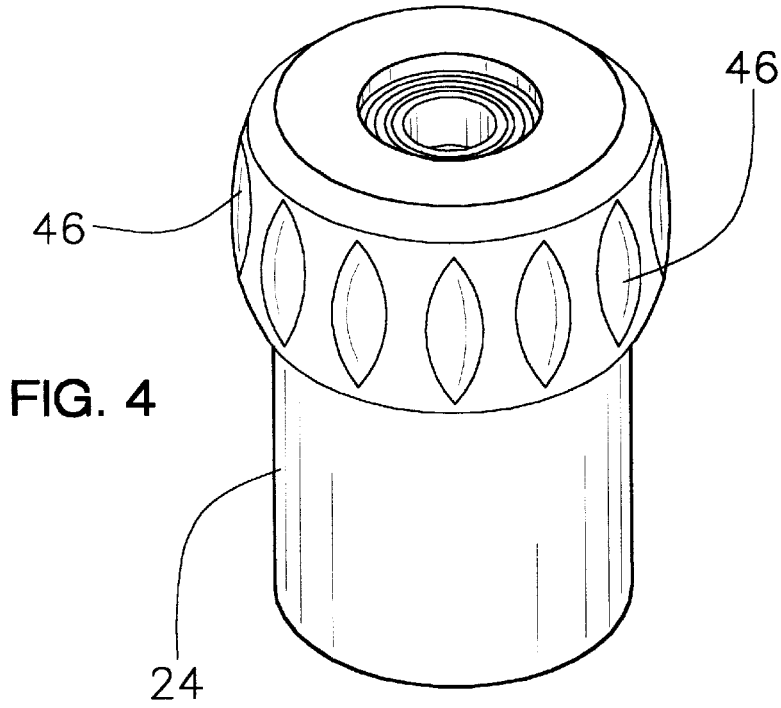
FIG. 4 is a schematic cross-sectional view of the present invention.

A cover member 24 has a top wall 26 and a perimeter wall 28 extending downward from a perimeter edge 30 of the top wall 26 the top wall 26 has a generally circular shape. The perimeter wall 28 has an inner threaded surface 32. The perimeter wall 28 has an inner diameter generally equal to an outer diameter of the tubular member 12 such that the cover member 24 may be positioned over and threadably coupled to the tubular member 12 when the cover member 24 is rotated in a first direction. The perimeter edge 30 has a pair of elongated slots 34 therein. Each of the slots 34 has a first end edge 36 and a second end edge 38. Each of a pair of elongate arcuate members 40 has a first end 42 and a second end 44. Each of the first ends 42 is positioned in one of the slots 34 and hingedly coupled to the perimeter edge 30 generally adjacent to a respective first edge 32 of the slots 34. Each of the arcuate members 40 is positionable between an open position extending outwardly from the cover member 24 and a closed position abutting the peripheral edge 30 and positioned in the respective slot 34. In the open position, the arcuate members 40 are biased against the first edges 36. Alternatively, the peripheral edge 30 may have a plurality of gripping members 46 as shown in FIG. 4.

A corkscrew 48 is elongated and has a first end 50 and a second end 52. The corkscrew 48 is threaded from the first end 50 to the second end 52. A disc 54 is attached to the first end 50. The disc 54 has a generally centrally located bore 56 therein. The bore 56 has channeled side walls 57 for gripping by a respectively designed tool. The corkscrew 48 is rotated in a second direction such that the second end 52 extends through the top wall 26 of the cover member 24 and into the cork 72. The disc 54 is sunken into a depression 58 in the top wall 26.

In use, the device 10 is preferably mounted onto the bottle 70 by the bottler of the liquid positioned in the bottle 70 and a covering positioned over the device 10. The tubular member 12 acts as a saddle positioned on the bottle 70. The cover member 24 is positioned over the saddle and the corkscrew 48 extended through the cover member and into the cork 42. When the cover member 24 is rotated in a second direction to remove it from the bottle 70, the corkscrew 48 remains in the cork 72 such that the cork 72 is lifted out of the bottle 70. The arcuate members 40 allow the user greater leverage when using the device 10. The channeled bore 56 allows the bottler to easily insert the corkscrew 48 with a respectively designed tool while the corkscrew 48 is not easily removed from the cork 72.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cork extracting and bottle system comprising:

a bottle having an open top end;

a cork being positioned in said open top end;

a tubular member having a first open end, a second open end and a peripheral wall extending between said first and second open ends, said peripheral wall having an outer threaded surface, said first open end having an inner annular shoulder thereon, said tubular member being positioned over the top end of the bottle such that said shoulder abuts the top end;

a cover member having a top wall and a perimeter wall extending downward from a perimeter edge of said top wall, said top wall having a generally circular shape, said perimeter wall having an inner threaded surface, said perimeter wall having an inner diameter generally equal to an outer diameter of said tubular member such that said cover member may be positioned over and threadably coupled to said tubular member when said cover member is rotated in a first direction, said perimeter edge having a pair of elongated slots therein, each of said slots having a first end edge and a second end edge, each of a pair of elongate arcuate members having a first end and a second end, each of said first ends being positioned in one of said slots and hingedly coupled to said perimeter edge generally adjacent to a respective first end edge of said slots, each of said arcuate members being positionable between an open position extending outwardly from said cover member and a closed position abutting said peripheral edge and positioned in the respective slot; and a corkscrew being elongate and having a first end and a second end and being threaded from said first end to said second end, a disc being attached to said first end, said disc having a generally centrally located bore therein, said bore having channeled side walls, said corkscrew being rotated in a first direction such that said second end extends through said top wall of said cover member and into the cork, said disc being sunken into a depression in said top wall;

wherein said cover member is rotated in said second direction such that the cork is extracted from the bottle.

* * * * *